US007233289B2

(12) United States Patent
Chung et al.

(10) Patent No.: US 7,233,289 B2
(45) Date of Patent: Jun. 19, 2007

(54) MULTIPLE-FREQUENCY ANTENNA STRUCTURE

(75) Inventors: Shyh-Jong Chung, HsinChu (TW); Ya-Ying Wang, Taipei (TW); Min-Chuan Wu, Tai-Chung (TW); Kuang-Yu Yen, Tai-Chung (TW)

(73) Assignee: Realtek Semiconductor Corp., HsinChu (TW)

( * ) Notice: Subject to any disclaimer, the term of this patent is extended or adjusted under 35 U.S.C. 154(b) by 10 days.

(21) Appl. No.: 11/160,984

(22) Filed: Jul. 19, 2005

(65) Prior Publication Data

US 2005/0275592 A1 Dec. 15, 2005

Related U.S. Application Data

(63) Continuation-in-part of application No. 10/605,952, filed on Nov. 10, 2003, now abandoned.

(51) Int. Cl.
*H01Q 1/38* (2006.01)

(52) U.S. Cl. ..... 343/700 MS; 343/702

(58) Field of Classification Search ..... 343/700 MS, 343/702, 818, 833, 834
See application file for complete search history.

(56) References Cited

U.S. PATENT DOCUMENTS

| | | | | |
|---|---|---|---|---|
| 6,002,369 | A | 12/1999 | Richard | |
| 6,008,773 | A | 12/1999 | Matsuoka et al. | |
| 6,028,567 | A * | 2/2000 | Lahti | 343/895 |
| 6,100,848 | A * | 8/2000 | Hayes | 343/702 |
| 6,529,170 | B1 | 3/2003 | Nishizawa et al. | |
| 6,774,853 | B2 | 8/2004 | Wong et al. | |
| 6,982,672 | B2 * | 1/2006 | Lin et al. | 343/700 MS |
| 7,050,010 | B2 * | 5/2006 | Wang et al. | 343/702 |
| 7,061,430 | B2 * | 6/2006 | Zheng et al. | 343/700 MS |
| 2001/0050643 | A1 * | 12/2001 | Egorov et al. | 343/702 |
| 2003/0122718 | A1 | 7/2003 | Fang et al. | |
| 2003/0222823 | A1 * | 12/2003 | Flint et al. | 343/702 |
| 2005/0093750 | A1 * | 5/2005 | Vance | 343/702 |
| 2006/0119517 | A1 * | 6/2006 | Futamata | 343/700 MS |

* cited by examiner

*Primary Examiner*—Hoang V. Nguyen
(74) *Attorney, Agent, or Firm*—Winston Hsu

(57) ABSTRACT

A multiple-frequency antenna includes a circuit board of dielectric material having a first surface and a second surface which is spaced apart from and is substantially parallel to the first surface, a ground plane layer of electrically conductive material covering a portion of the first surface of the circuit board, and a feed-line of electrically conductive material disposed on the second surface of the circuit board so as to extend over the ground plane layer. A first radiating element of electrically conductive material is disposed on the circuit board and electrically connected to the feed-line. A second radiating element of electrically conductive material is disposed on the circuit board in close proximity to the first radiating element for coupling with the first radiating element, the coupling providing an electromagnetic feed to the second radiating element.

28 Claims, 8 Drawing Sheets

MULTIPLE-FREQUENCY ANTENNA STRUCTURE

CROSS REFERENCE TO RELATED APPLICATIONS

This application is a continuation-in-part of applicant's earlier application, Ser. No. 10/605,952, filed on Nov. 10, 2003 now abandoned.

BACKGROUND OF THE INVENTION

1. Field of the Invention

The present invention relates to wireless network communications, and more specifically, to a multiple-frequency antenna structure for use in wireless local area network (WLAN) application.

2. Description of the Prior Art

The rapid development of the personal computer coupled with users' desires to transmit data between personal computers has resulted in the rapid expansion of local area networks. Today, the local area network has been widely implemented in many places such as in the home, public access areas, and the work place. However, the implementation of the local area network has been limited by its own nature. The most visible example of the limitation is the cabling. One solution to this problem is to provide personal computer with a wireless network interface card to enable the personal computer to establish a wireless data communication link. Using a wireless network interface card, a personal computer, such as a notebook computer, can provide wireless data transmission with other personal computers, or with a host computing device, such as a server connected to a conventional wired-line network.

The growth in wireless network interface cards, particularly in notebook computers, has made it desirable to enable personal computers to exchange data with other computing devices and has provided many conveniences to personal computer users. As a key component of a wireless network interface card, the antenna has received much attention and many improvements, especially in function and size. FIG. 1 shows a PCMCIA wireless network interface card 8 used in a notebook computer. The card can be used with a PCMCIA slot built in a notebook computer. As shown, the wireless network interface card 8 comprises a main body 23, and an extension portion 12. The main body 23 further comprises driving circuitries, connectors, etc. The extension portion 12 comprises a printed antenna 10 for transmitting and receiving wireless signals. Presently, the antennas being used widely in a wireless network interface card include the printed monopole antenna, chip antenna, inverted-F antenna, and helical antenna.

Among them, the printed monopole antenna is simple and inexpensive. As shown in FIG. 2, a printed monopole antenna 20 comprises a feed-line 21 a primary radiating element 22, a ground plane 24, and a dielectric material 25. The current on the printed monopole antenna is similar to current on a printed dipole antenna, so the electric field created will be the same. The difference is that the ground plane 24 of the printed monopole antenna 20 will create mirror current, so the total length of the printed monopole antenna 20 is only λg/4, which is half of the length of a printed dipole antenna. The improvement on the length of an antenna is significant in application for wireless network interface cards. The definition of the wavelength λg described above is $$\lambda_g = \frac{1}{\sqrt{\varepsilon_{re}}} * \frac{c}{f_0}$$

Wherein c is the speed of light, $f_0$ is the center frequency of electromagnetic waves, and $\epsilon_{re}$ is the equivalent dielectric constant and is between the nominal dielectric constant (around 4.4) of circuit board and the dielectric constant (around 1) of air. For example, if the center frequency is 2.45 GHz and the dielectric constant is 4.4, the length of the printed monopole antenna will be 2.32 cm. Since the space in a wireless network interface card reserved for an antenna is limited, an antenna with such length will not fit properly into a card, therefore, some modification for the antenna is required. In the U.S. Pat. No. 6,008,774 "Printed Antenna Structure for Wireless Data Communications", whose contents are incorporated herein by reference, modification for such antenna is disclosed. As shown in FIG. 3, the shape of a printed monopole antenna 30 has been changed in order to reduce the size thereof. The concept of U.S. Pat. No. 6,008,774 is to bend the primary radiating element 22 of FIG. 2 into the form of a V-shaped primary radiating element 32 as shown in FIG. 3. Although the overall length of the primary radiating element 32 of U.S. Pat. No. 6,008,774 is still λg/4, however, the space needed for furnishing this modified primary radiating element 32 is reduced. The antenna 30 shown in FIG. 3 also comprises a feed-line 31, the primary radiating element 32, a ground plane 34, and a dielectric material.

SUMMARY OF THE INVENTION

It is therefore one of the many objectives of the claimed invention to provide a multiple-frequency antenna with more design topology flexibility.

According to embodiments of the present invention, an antenna is disclosed. The antenna comprises a dielectric material; a feed-line of electrically conductive material disposed on the dielectric material, for transmitting electrical energy; a first radiating element of electrically conductive material disposed on the dielectric material and in physical contact with the feed-line, for operating at a first radio frequency; and a second radiating element of electrically conductive material disposed on the dielectric material and physically detached from the first radiating element, for operating at a second radio frequency; wherein the antenna is attached to a wireless local area network device.

According to embodiments of the present invention, an antenna is also disclosed. The antenna comprises a dielectric material; a first radiating element of electrically conductive material disposed on the dielectric material, for operating at a first radio frequency of about 5 GHz; and a second radiating element of electrically conductive material disposed on the dielectric material and electrically isolated from the first radiating element; wherein electro-magnetic energy coupling occurs between the first radiating element and the second radiating element, so that the second radiating element operates at a second radio frequency of about 2 GHz.

It is advantageous of the claimed invention that the second radiating element electro-magnetically couples with the first radiating element. This characteristic allows the multiple-frequency antenna to be built in a variety of different arrangements, and provides flexibility in the design of the antenna. Moreover, since the coupling provides an electromagnetic feed to the second radiating element, the first and second radiating elements serve to respectively generate first and second operating frequencies of the multiple-frequency antenna.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
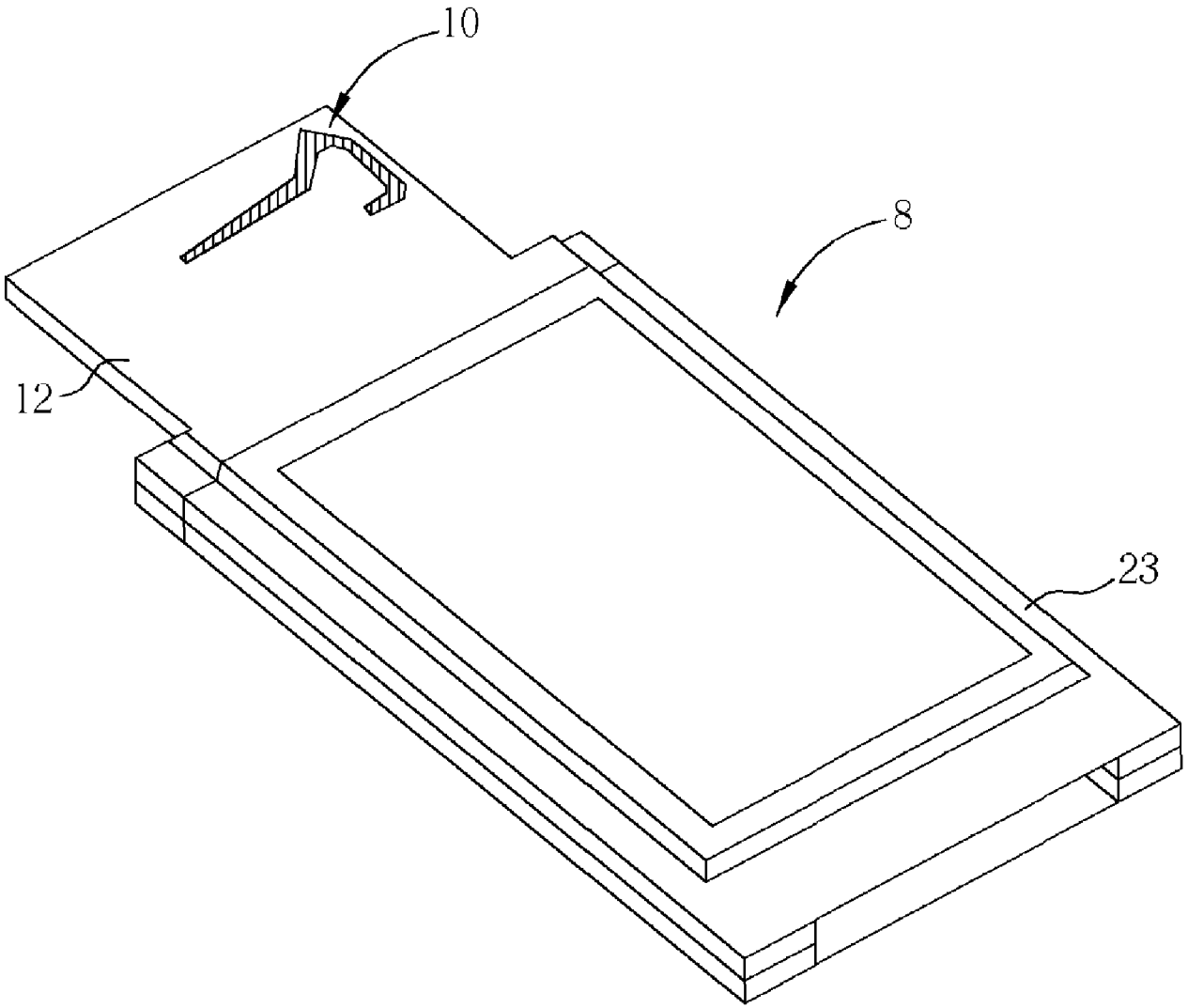
Fig. 1 Prior Art
FIG. 1 is a diagram showing a conventional wireless network interface card.
Figure 2:
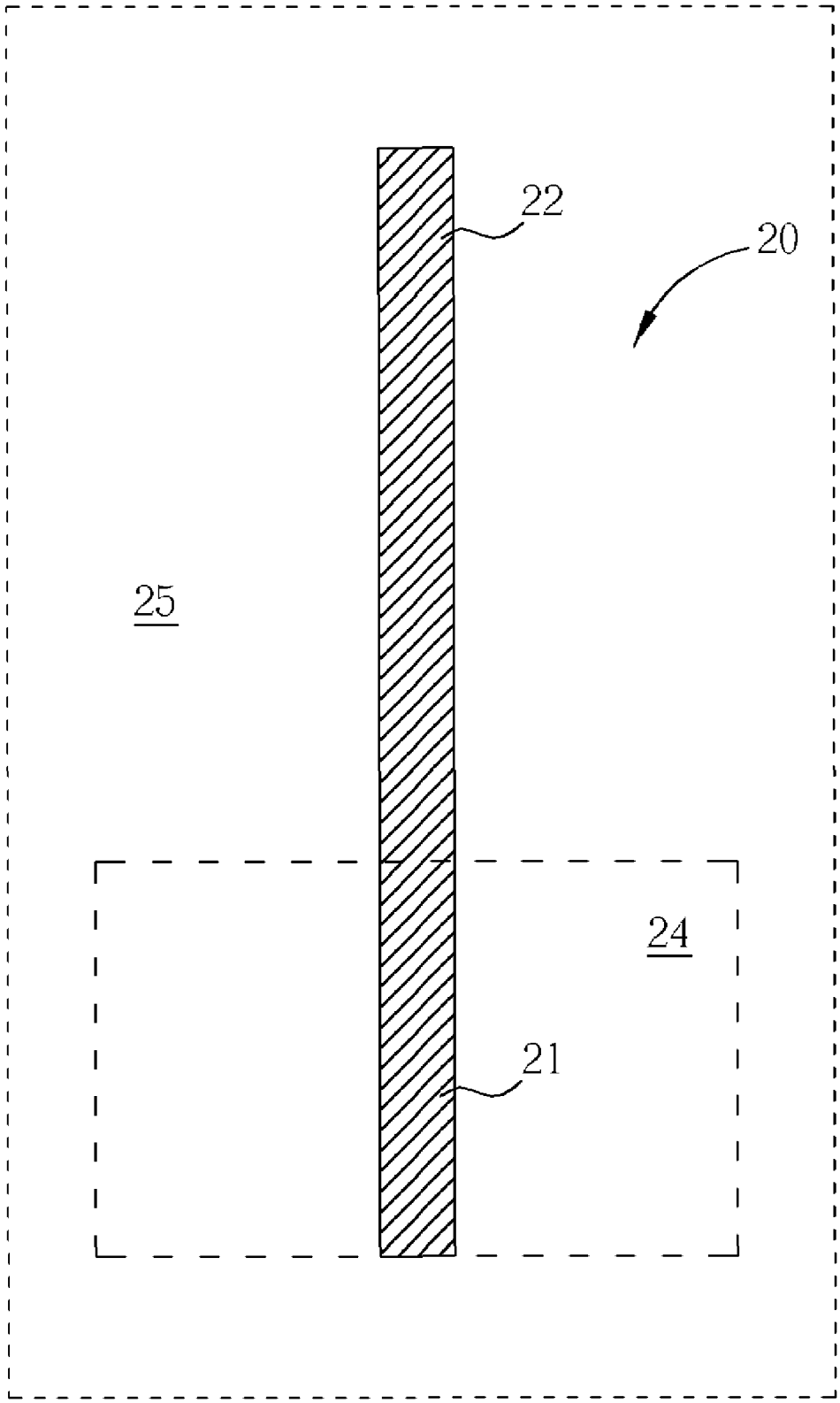
Fig. 2 Prior Art
FIG. 2 is a schematic diagram showing a conventional Printed Monopole Antenna.
Figure 3:
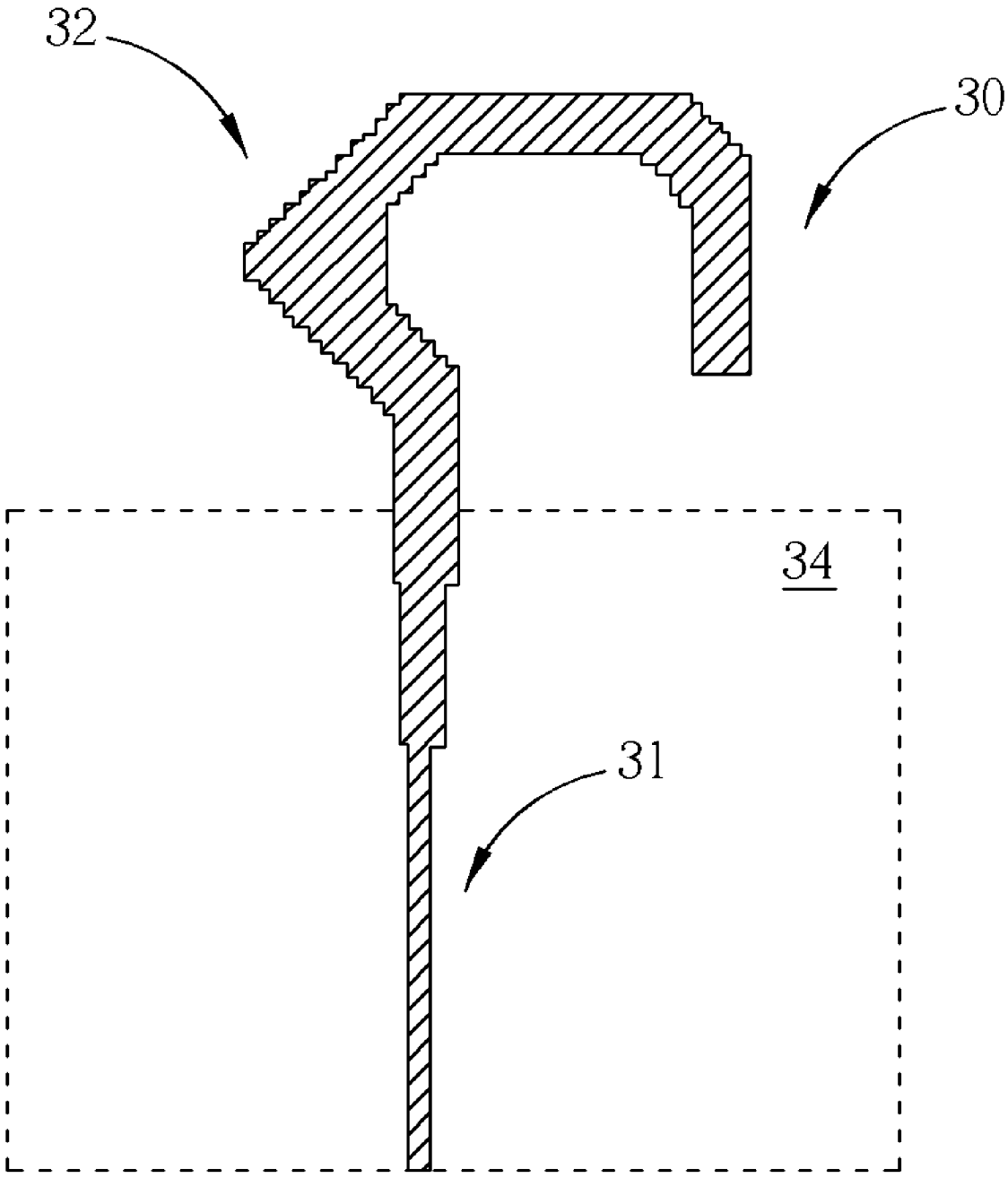
Fig. 3 Prior Art
FIG. 3 is a schematic diagram showing a conventional printed monopole antenna of U.S. Pat. No. 6,008,774.
Figure 4:
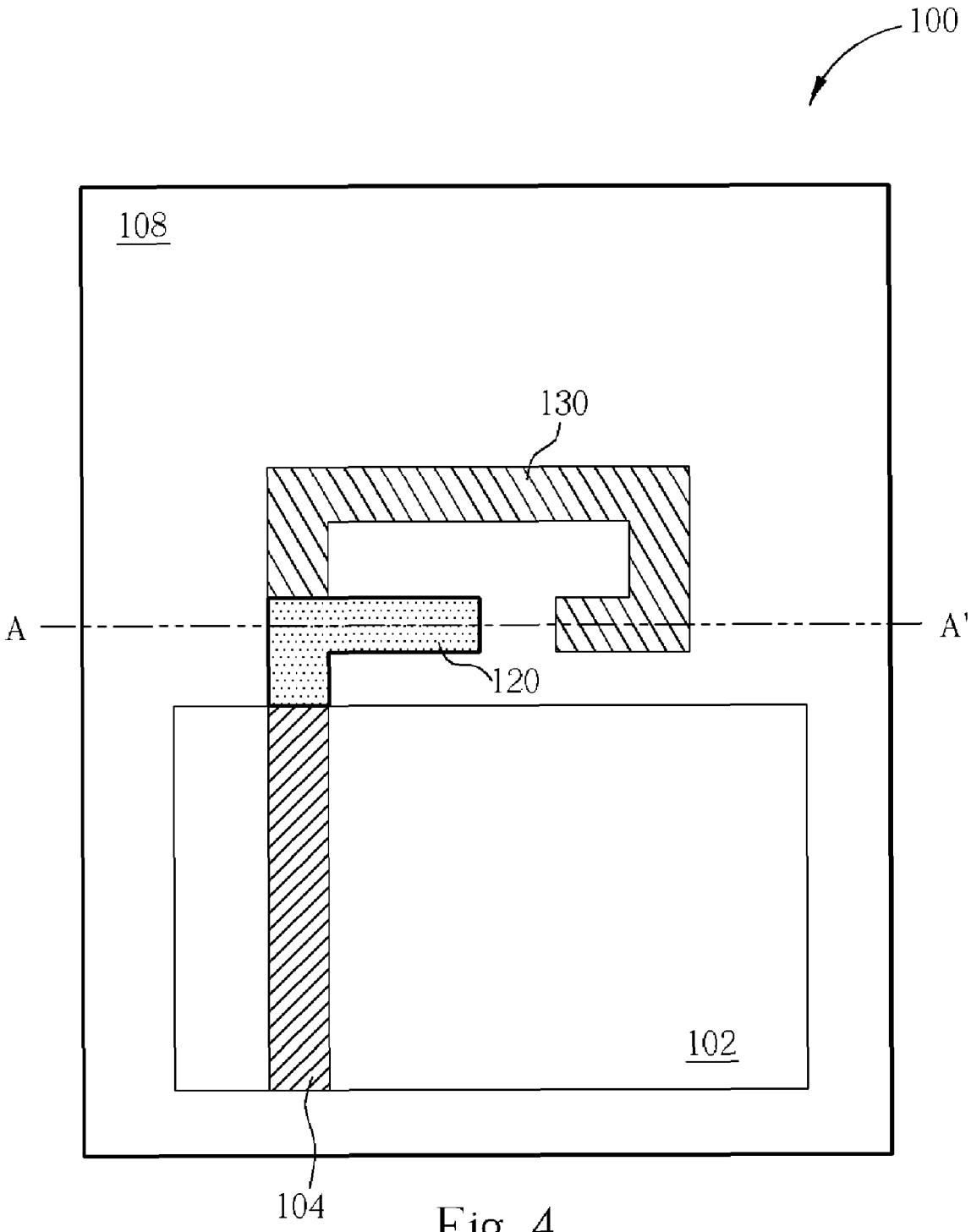
FIG. 4 is a top view diagram showing a multiple-frequency antenna according to a first embodiment of the present invention.
Figure 5:
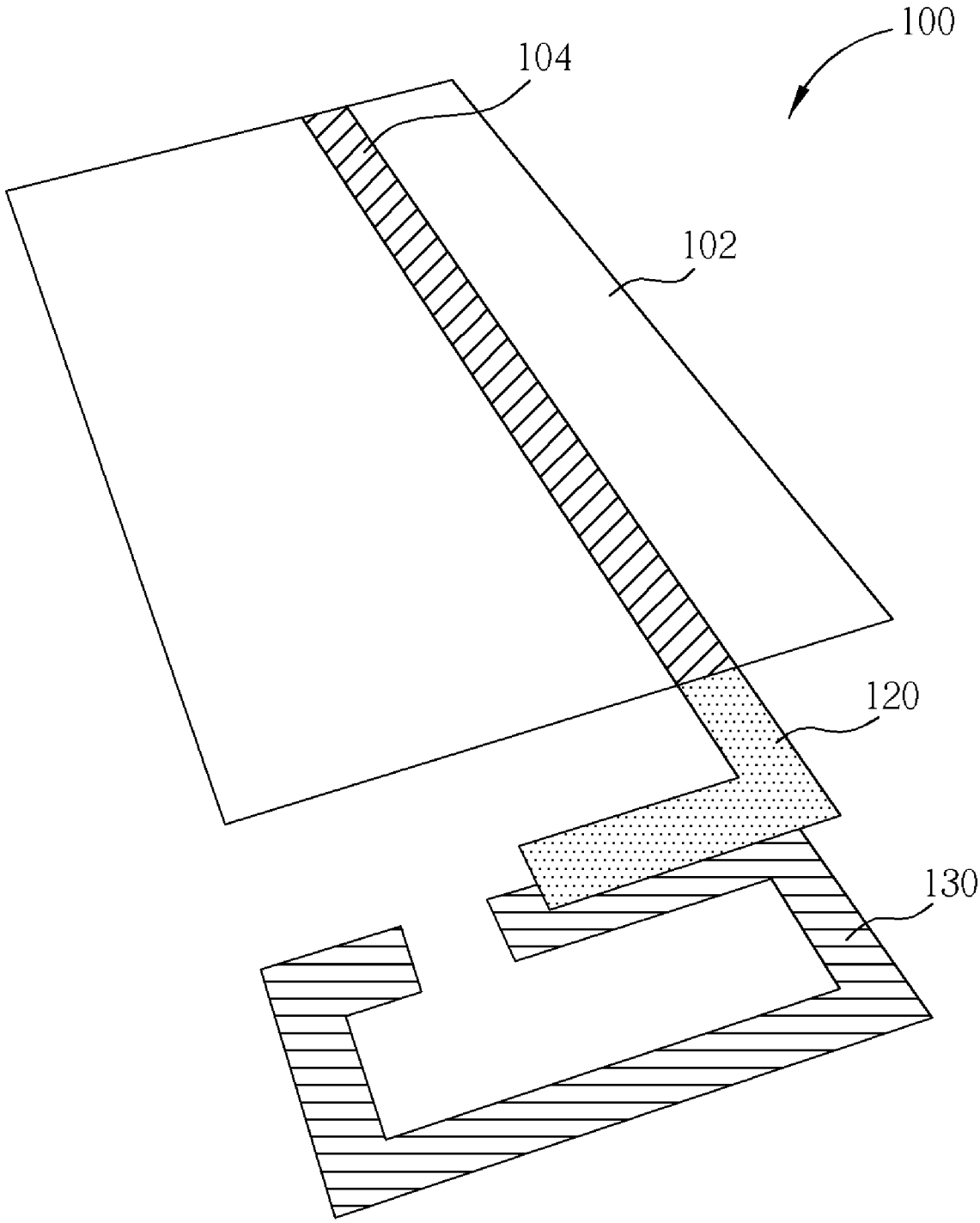
FIG. 5 is a perspective diagram of the antenna showing a layered arrangement of the antenna.
Figure 6:
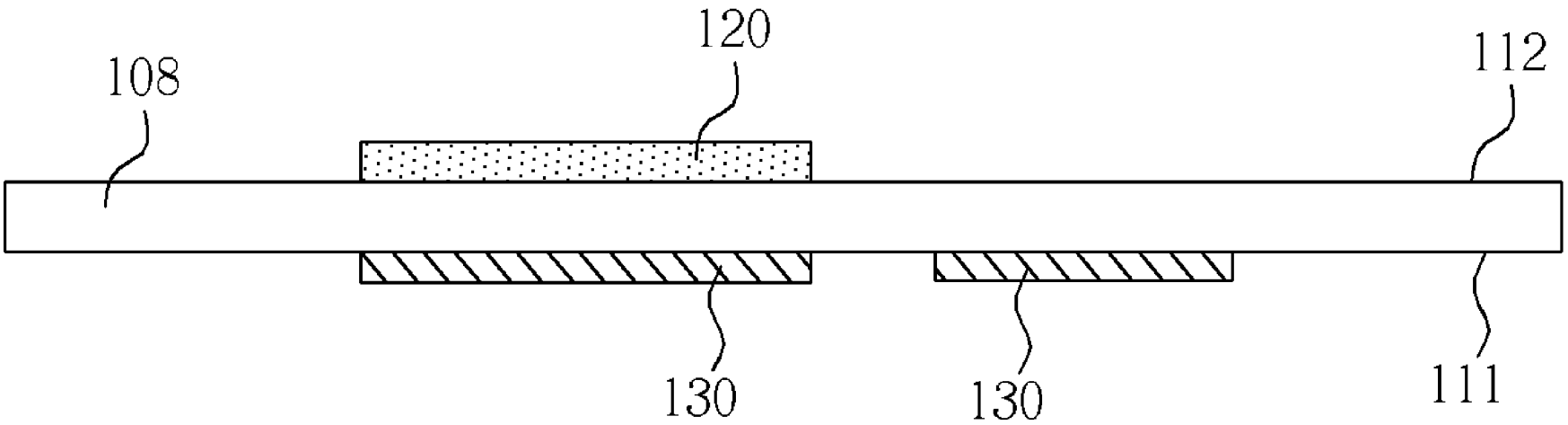
FIG. 6 is a cross-sectional view of the antenna taken at line A-A' in FIG. 4.

Please refer to FIGS. 4 to 6. FIG. 4 is a top view diagram showing a multiple-frequency antenna 100 according to a first embodiment of the present invention. FIG. 5 is a perspective diagram of the antenna 100 showing a layered arrangement of the antenna 100. FIG. 6 is a cross-sectional view of the antenna 100 taken at line A-A' in FIG. 4. As shown, a feed-line 104 is provided for receiving and transmitting wireless signals. The antenna 100 is formed on a dielectric layer 108 (for example, a circuit board made of dielectric material). As shown in FIG. 6, the dielectric layer 108 contains a first surface 111 and a second surface 112. The first and second surfaces 111 and 112 are spaced apart from and are substantially parallel to each other. A ground plane layer 102 covers some portion of the first surface 111 of the dielectric layer 108. The feed-line 104 is on the second surface 112 of the dielectric layer 108 and extends over the ground plane layer 102. One end of the feed-line 104 is electrically connected to driving circuitry (not shown in figures).

The antenna 100 contains a first radiating element 120 electrically connected to, in this case, in physical contact with, the feed-line 104 for serving to generate a first operating frequency of the antenna 100. The first radiating element 120 is preferably a monopole antenna, and a length of the first radiating element 120 is approximately one-quarter wavelength of the first operating frequency of the antenna 100.

In addition, the antenna 100 also contains a second radiating element 130 for serving to generate a second operating frequency of the antenna 100. As shown in FIGS. 4 to 6, the first radiating element 120 is disposed on the second surface 112 and the second radiating element 130 is disposed on the first surface 111 of the dielectric layer 108. The second radiating element 130 is not directly connected to the feed-line 104. Rather, the second radiating element 130 is physically detached from the feed-line and the first radiating element, and therefore electrically isolated from them, if considering the dielectric layer 108 an electrical insulator, as is generally recognized by those of ordinary skill in the art.

At least one portion of the second radiating element 130 is positioned in close proximity to a portion of the first radiating element 120 to establish electromagnetic coupling between the first and second radiating elements 120 and 130. The coupling provides an electromagnetic energy to feed to the second radiating element 130, and enables the second radiating element 130 to generate a second operating frequency of the antenna 100. The second radiating element 130 is preferably an open-loop resonator antenna, and a length of the second radiating element 130 is approximately one-half wavelength of the second operating frequency of the antenna 100. As shown in FIG. 6, the second radiating element 130 is disposed on the first surface 111 of the dielectric layer 108, and a portion of the second radiating element 130 overlaps with a portion of the first radiating element 120 that is disposed on the second surface 112. It should be noted that other arrangements of the first and second radiating elements 120 and 130 are possible. For instance, the first and second radiating elements 120 and 130 may be disposed on the same surface or different surfaces of the dielectric layer 108, so long as the first radiating element 120 is close enough to the second radiating element 130 to establish the energy coupling. The feed-line 104, the first radiating element 120, and the second radiating element 130 are all made of electrically conductive material.

Please note that, in this embodiment of a wireless local area network (WLAN) application, the multiple-frequency antenna is attached to and co-operates with a WLAN device, for example, a WLAN interface card, or an access point, with such a multiple-band need. In one preferred embodiment, the first radiating element can be configured to operate at a radio frequency of about 5 GHz (i.e., the 5 GHz band), which is the nominal operating frequency of 802.11a standard, while the second radiating element can be configured to operate at a radio frequency of about 2.4 GHz (i.e., the 2.4 GHz band), which is the nominal operating frequency of both 802.11b as well as 802.11g GHz standards. Although it is also well known to those of ordinary skill in the art that these nominal operating frequencies of these Wi-Fi standards generally allow for certain degree of deviation when actually implemented, and these insubstantial deviations of operating frequency should not affect the scope of protection of the present invention. It is also noted that the antenna described in the embodiments can be easily adapted for use with other frequency ranges, or with potential future derivation and evolvement in wireless network communications standards.

Figure 7:
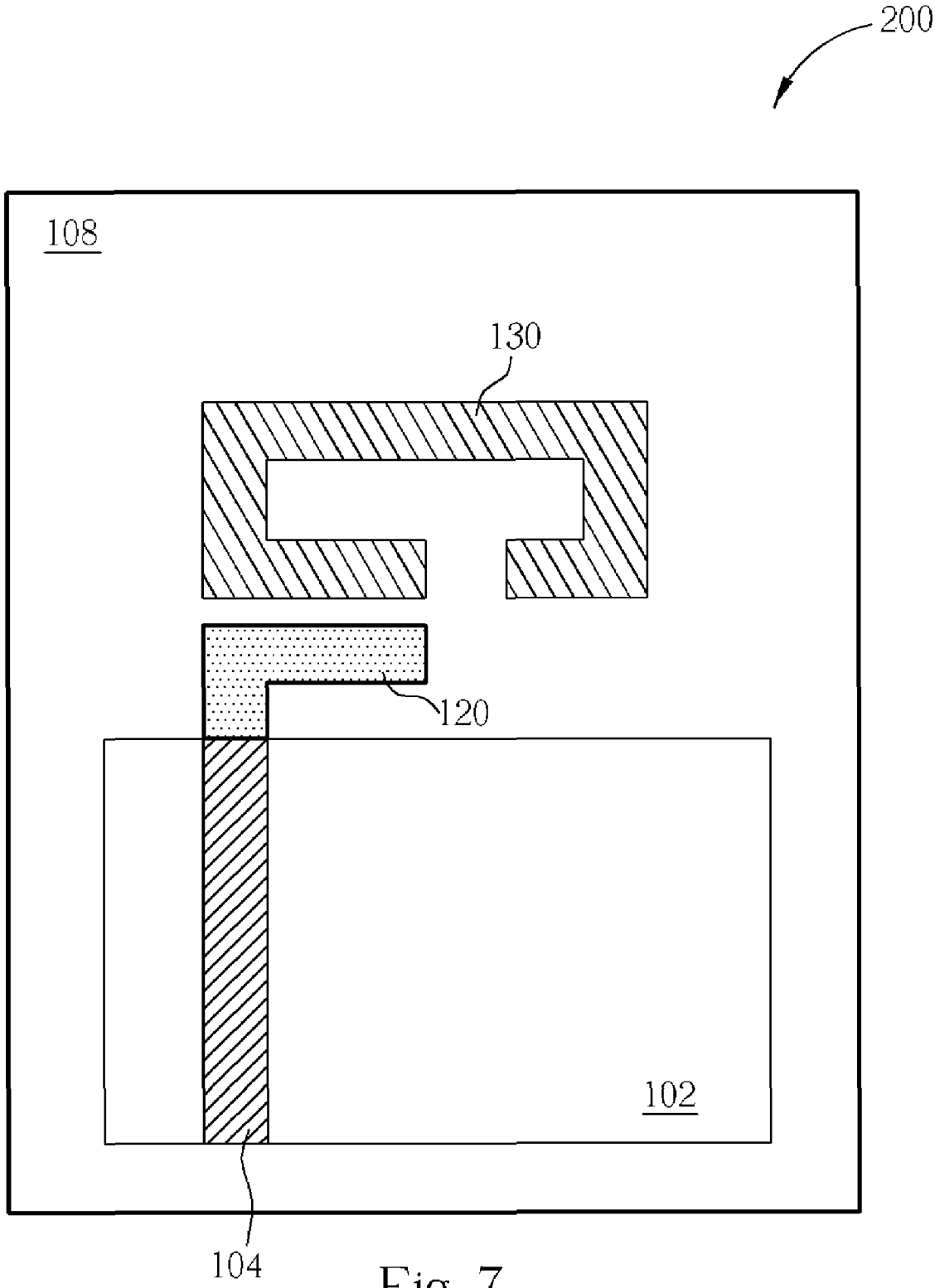
FIG. 7 is a top view diagram showing a multiple-frequency antenna according to a second embodiment of the present invention.

Please refer to FIG. 7. FIG. 7 is a top view diagram showing a multiple-frequency antenna 200 according to a second embodiment of the present invention. In the antenna 200, the first radiating element 120 and the second radiating element 130 are both disposed on the second surface 112 of the dielectric layer 108. Similarly, a portion of the second radiating element 130 is in close proximity to a portion of the first radiating element 120, so as to allow the energy coupling to take place.

Figure 8:
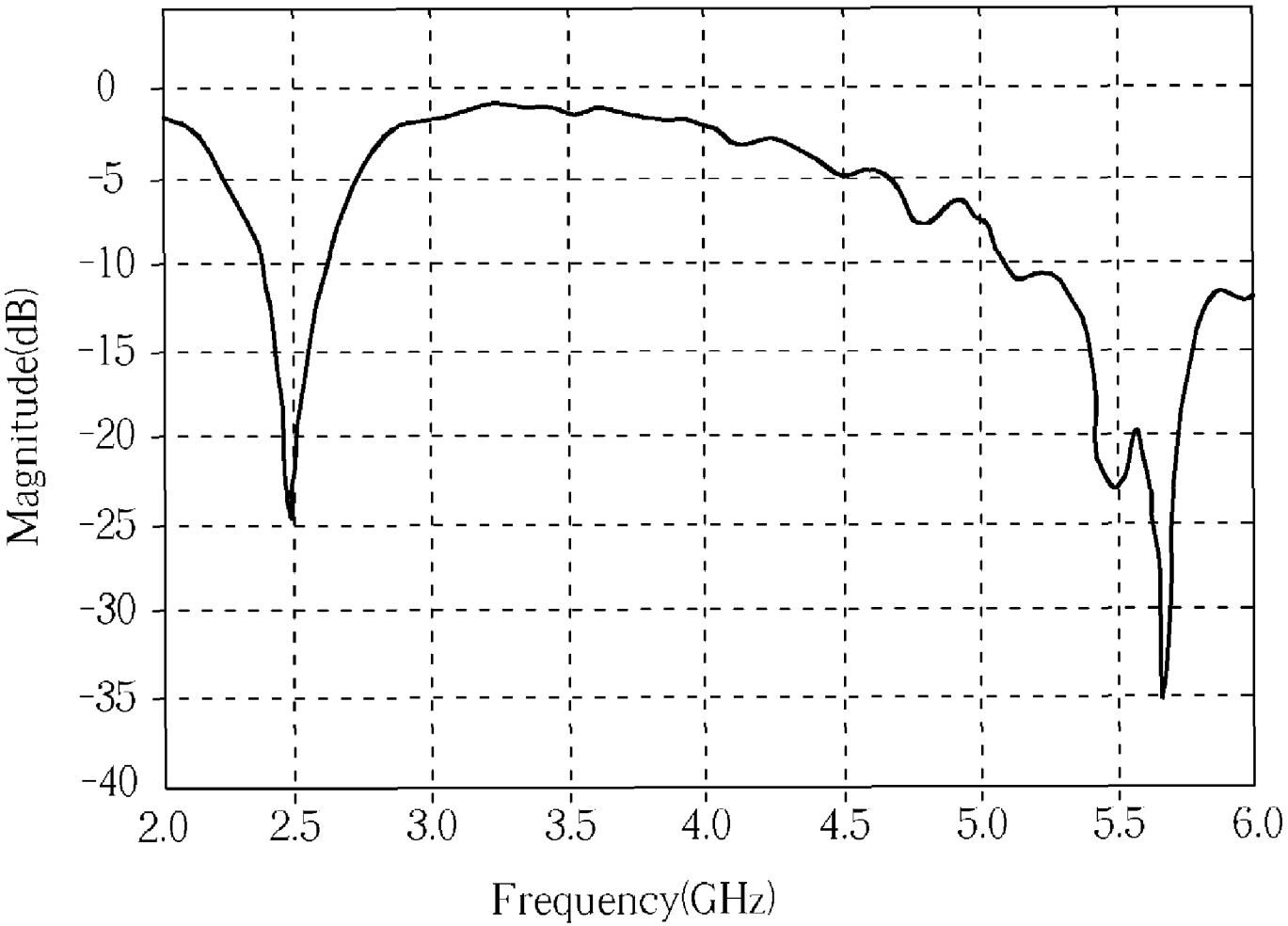
FIG. 8 is a plot diagram showing a relationship between measured return loss and frequency of the antenna according to the present invention.

Please refer to FIG. 8. FIG. 8 is a plot diagram showing a relationship between measured return loss and frequency of the antenna 100 according to the present invention. In FIG. 8, the first operating frequency produced by the first radiating element 120 has a frequency centered at approximately 5.5 GHz. The corresponding frequency band having a magnitude of −10 dB ranges from 5.05 to 6.02 GHz. The second operating frequency produced by the second radiating element 130 has a frequency centered at approximately 2.45 GHz. The corresponding frequency band having a magnitude of −10 dB ranges from 2.35 to 2.6 GHz.

The antenna disclosed in the embodiments of the present invention contains two radiating elements for generating first and second operating frequencies. The first radiating element couples with the second radiating element to provide an electromagnetic energy to feed to the second radiating element. Because coupling is involved, and the second radiating element does not have to be directly connected to the feed-line, greater flexibility is achieved in designing the antenna.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. An antenna, comprising:

a dielectric material;

a feed-line of electrically conductive material disposed on the dielectric material, for transmitting electrical energy;

a first radiating element of electrically conductive material disposed on the dielectric material and in physical contact with the feed-line, for operating at a first radio frequency; and a second radiating element of electrically conductive material disposed on the dielectric material and physically detached from the first radiating element, for operating at a second radio frequency, the second radiating element being a half-wavelength resonator at the second radio frecquency;

wherein the antenna is attached to a wireless local area network device.

2. The antenna of claim 1, wherein the first radio frequency is within the 5 GHz frequency band, and the second radio frequency is within the 2.4 GHz frequency band.

3. The antenna of claim 1, further comprising:

a ground layer covering at least a portion of a surface of the dielectric material.

4. The antenna of claim 1, wherein the dielectric material has a first surface and a second surface.

5. The antenna of claim 4, wherein the first surface and the second surface of the dielectric material are substantially parallel to each other.

6. The antenna of claim 4, wherein the first radiating element and the second radiating element are both disposed on the first surface of the dielectric material.

7. The antenna of claim 4, wherein the first radiating element is disposed on the first surface of the dielectric material, and the second radiating element is disposed on the second surface of the dielectric material.

8. The antenna of claim 1, wherein the first radiating element is a monopole antenna.

9. An antenna, comprising:

a dielectric material;

a first radiating element of electrically conductive material disposed on the dielectric material, for operating at a first radio frequency of about 5 GHz; and a second radiating element of electrically conductive material disposed on the dielectric material and electrically isolated from the first radiating element;

wherein electro-magnetic energy coupling occurs between the first radiating element and the second radiating element, so that the second radiating element operates at a second radio frequency of about 2.4 GHz, and the second radiating element is a half-wavelength resonator at the second radio frecquency.

10. The antenna of claim 9, further comprising:

a feed-line of electrically conductive material disposed on the dielectric material and electrically conducting to the first radiating element, for transmitting electrical energy.

11. The antenna of claim 9, wherein the antenna is attached to a wireless local area network (WLAN) device.

12. The antenna of claim 9 further comprising:

a ground layer covering at least a portion of a surface of the dielectric material.

13. The antenna of claim 9, wherein the dielectric material has a first surface and a second surface.

14. The antenna of claim 13, wherein the first surface and the second surface of the dielectric material are substantially parallel to each other.

15. The antenna of claim 13, wherein the first radiating element and the second radiating element are both disposed on the first surface of the dielectric material.

16. The antenna of claim 13, wherein the first radiating element is disposed on the first surface of the dielectric material, and the second radiating element is disposed on the second surface of the dielectric material.

17. The antenna of claim 9, wherein the first radiating element is a monopole antenna.

18. An antenna, comprising:

a dielectric material;

a feed-line of electrically conductive material disposed on the dielectric material, for transmitting electrical energy;

a first radiating element of electrically conductive material disposed on the dielectric material and in physical contact with the feed-line, for operating at a first radio frequency, the first radiating element being a monopole antenna; and a second radiating element of electrically conductive material disposed on the dielectric material and physically detached from the first radiating element, for operating at a second radio frequency;

wherein the antenna is attached to a wireless local area network device.

19. The antenna of claim 18, wherein the dielectric material has a first surface and a second surface.

20. The antenna of claim 19, wherein the first surface and the second surface of the dielectric material are substantially parallel to each other.

21. The antenna of claim 19, wherein the first radiating element and the second radiating element are both disposed on the first surface of the dielectric material.

22. The antenna of claim 19, wherein the first radiating element is disposed on the first surface of the dielectric material, and the second radiating element is disposed on the second surface of the dielectric material.

23. An antenna, comprising:

a dielectric material;

a first radiating element of electrically conductive material disposed on the dielectric material, for operating at a first radio frequency of about 5 GHz, the first radiating element being a monopole antenna; and a second radiating element of electrically conductive material disposed on the dielectric material and electrically isolated from the first radiating element;

wherein electro-magnetic energy coupling occurs between the first radiating element and the second radiating element, so that the second radiating element operates at a second radio frequency of about 2.4 GHz.

24. The antenna of claim 23, wherein the antenna is attached to a wireless local area network (WLAN) device.

25. The antenna of claim 23, wherein the dielectric material has a first surface and a second surface.

26. The antenna of claim 25, wherein the first surface and the second surface of the dielectric material are substantially parallel to each other.

27. The antenna of claim 25, wherein the first radiating element and the second radiating element are both disposed on the first surface of the dielectric material.

28. The antenna of claim 25, wherein the first radiating element is disposed on the first surface of the dielectric material, and the second radiating element is disposed on the second surface of the dielectric material.

* * * * *